US005372113A

United States Patent [19]

Smith

[11] Patent Number: 5,372,113

[45] Date of Patent: Dec. 13, 1994

[54] WEIR CONTROL OF FUEL LEVEL IN A FUEL RAIL TUBE FOR REDUCING THE RISK OF HYDRA-LOCK

[75] Inventor: John C. Smith, Newport News, Va.

[73] Assignee: Siemens Automotive L.P., Auburn Hills, Mich.

[21] Appl. No.: 186,839

[22] Filed: Jan. 25, 1994

[51] Int. Cl.[5] ..... F02M 55/02

[52] U.S. Cl. ..... 123/470; 123/456

[58] Field of Search ..... 123/470, 472, 468, 469, 123/456

[56] References Cited

U.S. PATENT DOCUMENTS

| | | | |
|---|---|---|---|
| 4,334,512 | 6/1982 | Biernath | 123/469 |
| 4,860,710 | 8/1989 | Hafner | 123/469 |
| 5,058,554 | 10/1991 | Takeda | 123/470 |
| 5,058,555 | 10/1991 | Haboush | 123/456 |
| 5,070,844 | 12/1991 | Daly | 123/470 |
| 5,080,070 | 1/1992 | Hafner | 123/472 |
| 5,090,385 | 2/1992 | Usui | 123/468 |

FOREIGN PATENT DOCUMENTS

| | | | |
|---|---|---|---|
| 4758829 | 3/1992 | European Pat. Off. | 123/470 |
| 0163465 | 6/1990 | Japan | 123/470 |
| 0188670 | 7/1990 | Japan | 123/470 |
| 4076264 | 3/1992 | Japan | 123/470 |

*Primary Examiner*—Carl S. Miller

*Attorney, Agent, or Firm*—George L. Boller; Russel C. Wells

[57] ABSTRACT

Sockets of a fuel rail assembly having bottom-feed fuel injectors communicate with a main fuel tube that serves all fuel injectors by means of holes in the sockets' sidewalls proximate the top of the main fuel tube. Below these holes, each socket is imperforate so as to dam the main fuel tube whereby the lowest level of any hole defines a weir level for fuel in the main fuel tube. If the lower seal between any fuel injector and its socket is compromised while the fuel is unpressurized, the fuel below the weir level will not drain out of the main fuel tube.

4 Claims, 1 Drawing Sheet

WEIR CONTROL OF FUEL LEVEL IN A FUEL RAIL TUBE FOR REDUCING THE RISK OF HYDRA-LOCK

FIELD OF THE INVENTION

This invention relates generally to fuel rail assemblies for internal combustion engines, and in particular to a fuel rail assembly that comprises bottom-feed type fuel injectors.

BACKGROUND AND SUMMARY OF THE INVENTION

A bottom-feed fuel injector is one that comprises a fuel inlet port in its side a short distance above its nozzle, whereas a top-feed fuel injector comprises a fuel inlet port at its top end opposite its nozzle. A fuel rail assembly comprising bottom-feed fuel injectors comprises injector-receiving sockets that are open at both top and bottom ends. The open top end of a socket provides for a bottom-feed fuel injector to be inserted into and removed from the socket while the open bottom end allows the fuel injector nozzle to be placed in communication with an intake manifold runner that leads to an engine cylinder. The socket is shaped with shoulders for properly locating the fuel injector, and with the fuel injector properly seated in the socket, an upper O-ring seal that is disposed around the outside of the fuel injector above the fuel inlet port provides sealing contact with the socket wall to prevent fuel from leaking through the open top of the socket, and a lower O-ring seal that is disposed around the outside of the fuel injector below the inlet port provides sealing contact with the socket wall to prevent fuel leakage from the bottom of the socket. These two O-ring seals form top and bottom boundaries of a fuel zone of the socket that receives pressurized fuel through a main tube that serves fuel to a number of injector-containing sockets along its length. The fuel inlet port of each installed fuel injector is exposed to this fuel zone in its socket in order to receive pressurized fuel. The top of the fuel injector that is outside the socket contains an electrical connector that is connected to an electronic control unit that operates each fuel injector at the proper time. In order to secure each fuel injector in its socket, a retainer, typically in the form of a clip or bar, is releasably fastened to the fuel rail assembly so that only when it is unfastened can the fuel injector be removed.

When an engine-mounted fuel rail assembly is serviced, proper procedure calls for the entire assembly to be removed so that the fuel injectors, whether they be top-or bottom-feed, remain sealed to their sockets. If the proper procedure is not followed, such as by unseating or removing a fuel injector from its socket, resulting in loss of integrity of the bottom seal of a fuel injector to its socket, there is a risk that fuel in the assembly will drain by gravity out through the bottom of the affected socket. While escape of fuel in this manner is obviously undesirable, there is less likelihood of draining fuel intruding into an engine cylinder in the case of a fuel rail assembly that has top-feed fuel injectors in comparison to one having bottom-feed fuel injectors. This is because the nozzle ends of the top-feed fuel injectors will typically remain seated in the manifold runners if the fuel rail's sockets are separated from the tops of top-feed fuel injectors. Such will not be the case for bottom-feed fuel injectors. If the bottom seal is compromised while the fuel rail assembly is mounted on an engine, liquid fuel can immediately drain by gravity into the manifold runner, and if an intake valve to the corresponding engine cylinder is opened, the fuel may drain into the cylinder. A condition where a cylinder contains excess fuel is sometimes called "hydra-lock", and an attempt to start an engine with this condition may cause major engine damage.

The present invention relates to a means for minimizing, or possibly even eliminating, the possibility of hydra-locking an engine when the lower seal of a bottom-feed fuel injector is compromised while the fuel rail assembly is on an engine. Briefly, the invention contemplates the inclusion of a weir for damming the main fuel tube at each location where it communicates with a socket containing a bottom-feed fuel injector. The weir defines a level that fuel in the main fuel tube must overflow before it can flow into a socket. This level is neither so high nor is it so sized that it impedes the flow of fuel into a socket when pressurized fuel is delivered to the fuel rail assembly, but it is high enough that when the fuel is not pressurized, and the integrity of a lower fuel injector seal is compromised with the fuel rail assembly on the engine, at most only a minority of fuel, namely that which is above the weir level, has the potential to leak out of the fuel rail assembly, while a majority, namely that which is below the weir level, will not leak out. According to the disclosed embodiment of the invention, a weir level is created at each socket by making that portion of the socket's sidewall that intersects the main fuel tube fully imperforate except for a series of holes that allow the main fuel tube to communicate with the socket proximate the highest level of the main fuel tube. Thus, only fuel that is at or above that highest level has the potential to drain by gravity from the fuel rail since the dam created by the weir will prevent fuel at a lower level from draining out.

Principles of the invention will be seen in the ensuing description and claims that are accompanied by a drawing illustrating a presently preferred embodiment of the invention according to the best mode contemplated at this time for carrying out the invention.

DESCRIPTION OF THE PREFERRED EMBODIMENT

Figure 1:
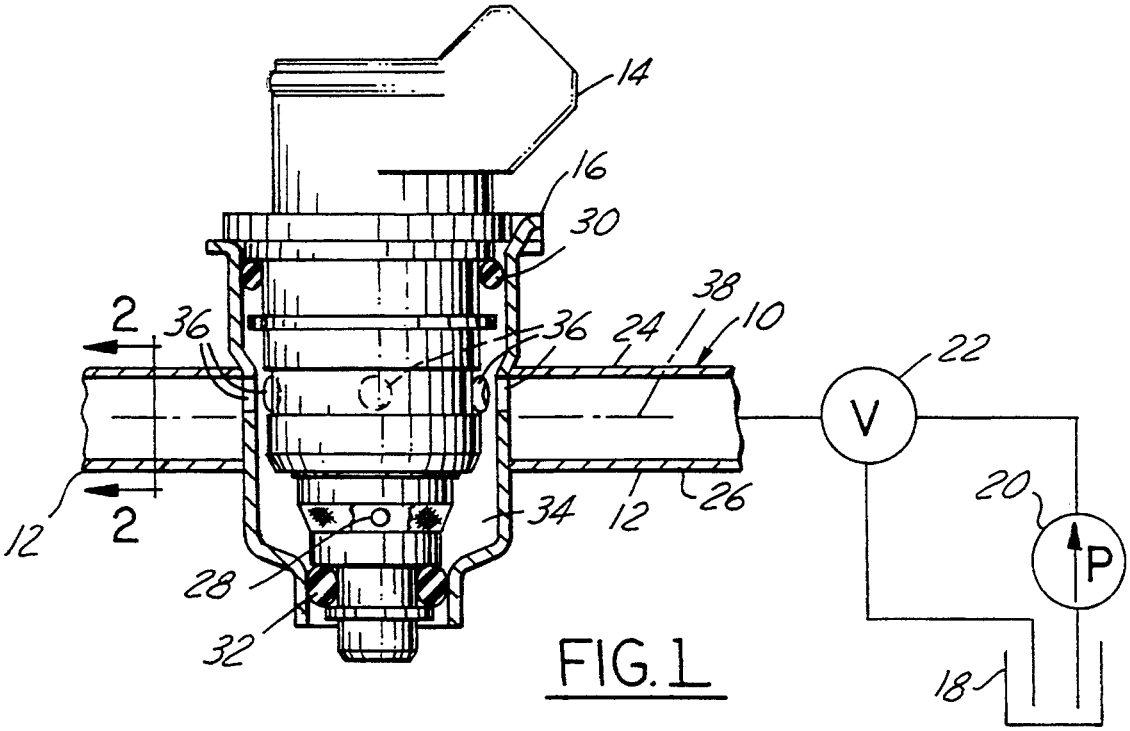
FIG. 1 is an elevational view partly in cross section and partly schematic of a representative fuel rail assembly embodying principles of the invention.
Figure 3:
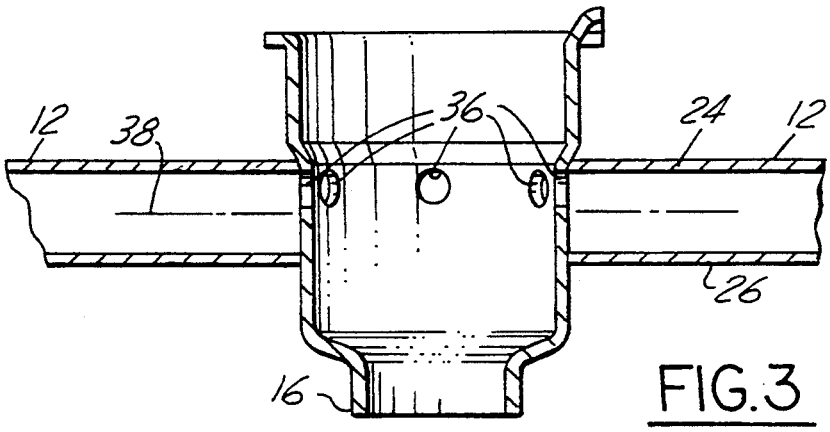
FIG. 3 is a view similar to FIG. 1 with portions removed.
Figure 2:
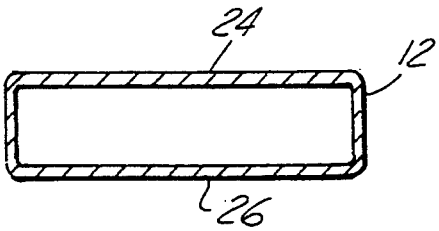
FIG. 2 is a transverse cross section taken in the direction of arrows 2—2 in FIG. 1.

A fuel rail assembly 10 comprises a main fuel tube 12 comprising a main fuel passage that serves a number of fuel injectors 14 that are mounted in respective sockets 16 at various locations along the length of tube 12, although FIG. 1 shows only a single one of several otherwise substantially identical injector-containing sockets. In use, fuel rail assembly 10 is mounted on an internal combustion engine (not shown) and is supplied with pressurized liquid fuel drawn from a tank 18 by a fuel pump 20. The liquid fuel pressure in tube 12 is regulated by a pressure regulator 22 that returns excess fuel to tank 18.

Tube 12 is rectangular in cross section, having top and bottom walls 24, 26 and containing aligned circular holes in these two walls at the location of each socket 16. Each socket 16 transversely intersects tube 12 at a right angle, passing through and being joined to the top and bottom tube walls in a fluid-tight manner so that fuel in the tube cannot leak out through the joints. Each socket 16 has a generally tubular shape that is open at both top and bottom ends. A fuel injector 14 is inserted into and removed from a socket via the opening at the top of the socket, and the socket is shaped with shoulders for locating the fuel injector in properly seated position when it is inserted into the socket. Although not shown in FIG. 1, a retainer in the form of a bar or a clip separably mounts on the assembly to retain each fuel injector in seated position in its socket.

Each fuel injector 14 is a bottom-feed type that has a fuel inlet port 28 in its side. There are top and bottom O-ring seals 30, 32 disposed around the outside of the fuel injector on opposite sides of inlet port 28 for sealing the fuel injector to the inside wall of the socket so that fuel cannot leak out of the fuel rail assembly between the fuel injector and the open ends of the socket. These seals form upper and lower boundaries of a fuel zone 34 to which inlet port 28 is exposed within the socket. The open lower end of the socket provides for fuel to be injected from the injector's bottom nozzle into an induction runner passage (not shown) that leads to an engine cylinder.

Each fuel zone 34 communicates with tube 12 by means of a series of holes 36 that extend through the sidewall of the corresponding socket 16 in the region where the socket intersects the tube. These holes are located proximate the highest level of tube 12 so that the portion of the socket sidewall that is below them in the region of the socket's intersection with the tube is imperforate. This imperforate portion of each socket forms a weir for fuel in tube 12. The weir level is defined by the lowest portion of any of the holes 36, and since the holes are of the same size and at the same level in a socket, the weir level is defined by all the holes 36, assuming that tube 12 is perfectly horizontal. Reference numeral 38 represents the weir level. The holes 36 are of sufficient size and number that delivery of fuel to all sockets 16 served by tube 12 is not restricted, yet the weir level is noticeably higher than the middle of tube 12. If integrity of a lower seal with its socket is compromised while the fuel rail assembly is on the engine and fuel in it is not under pressure, only fuel that is above the weir level has the potential to drain by gravity through the bottom opening of the affected socket, thereby preventing the fuel rail assembly from being completely drained of fuel. By reducing the amount of fuel that might otherwise drain, the invention serves to reduce the risk of hydra-locking, although there can be no guarantee that in any given case engine damage will not occur.

The illustrated embodiment is advantageous, because the weir is provided in the socket itself simply by the size, number, and location of holes 36. While a presently preferred embodiment of the invention has been illustrated and described, it should be appreciated that principles are applicable to other embodiments.

What is claimed is:

1. A fuel rail assembly for an internal combustion engine comprising a tubular-walled main fuel passage transversely intersected by at least one socket for receiving a respective bottom-feed fuel injector, a bottom-feed fuel injector received in said socket and comprising a fuel inlet port through which fuel enters and a nozzle from which fuel is injected, each said socket comprising a top end having a top opening via which the respective bottom-feed fuel injector is associated with and disassociated from said fuel rail assembly by insertion into and removal from the respective socket via the respective socket's top end and a bottom end having a bottom opening for allowing the respective fuel injector to spray fuel from the respective socket into such an engine, top sealing means for sealing between each fuel injector and the respective socket proximate the respective socket's top end to prevent fuel from leaking out of the respective socket via the respective socket's top end, bottom sealing means for sealing between each fuel injector and the respective socket proximate the respective socket's bottom end to prevent fuel from leaking out of the respective socket via the respective socket bottom end, said fuel inlet port of each fuel injector being disposed between the respective top and bottom sealing means, means placing a zone of each socket that lies between the respective top and bottom sealing means in fluid communication with said main fuel passage, including means defining a weir level for said main fuel passage that is effective to allow fuel to flow from said main fuel passage into each zone when said main fuel passage is pressurized with liquid fuel and that is effective to prevent fuel in said main fuel passage that is below weir level from draining from said main fuel passage into said zones when fuel in said main fuel passage is not pressurized, and in which said weir level is established to prevent at least more than half the fuel in said main fuel passage from draining out of said main fuel passage when fuel in said main fuel passage is not pressurized,

2. A fuel rail assembly as set forth in claim 1 in which said means defining a weir level comprises one or more holes which extend through a sidewall of said socket and via which said socket is in fluid communication with said main fuel passage.

3. A fuel rail assembly as set forth in claim 1 in which said main fuel passage has a non-circular transverse cross section.

4. A fuel rail assembly as set forth in claim 3 in which said tubular-walled main fuel passage comprises top and bottom parallel walls, each socket passes through respective aligned holes in said top and bottom walls and is joined in fluid-tight manner to said top and bottom walls at the respective holes therein.

* * * * *